US009227747B2

(12) United States Patent
Dupont et al.

(10) Patent No.: US 9,227,747 B2
(45) Date of Patent: Jan. 5, 2016

(54) METHOD FOR PACKAGING NON-LIQUID FOOD PRODUCTS, IN PARTICULAR THOSE SENSITIVE TO OXYGEN, IN A CONTAINER WITH A LOW OXYGEN CONTENT

(75) Inventors: Laurent Dupont, Renescure (FR); Stéphane Gauthier, Renescure (FR)

(73) Assignee: BONDUELLE, Renescure (FR)

( * ) Notice: Subject to any disclaimer, the term of this patent is extended or adjusted under 35 U.S.C. 154(b) by 667 days.

(21) Appl. No.: 13/519,402

(22) PCT Filed: Sep. 19, 2011

(86) PCT No.: PCT/FR2011/000505

§ 371 (c)(1),
(2), (4) Date: Aug. 17, 2012

(87) PCT Pub. No.: WO2012/038615

PCT Pub. Date: Mar. 29, 2012

(65) Prior Publication Data

US 2012/0308699 A1 Dec. 6, 2012

(30) Foreign Application Priority Data

Sep. 20, 2010 (FR) ..... 10 03723

(51) Int. Cl.
*B65B 3/00* (2006.01)
*B65B 31/02* (2006.01)
*B65B 3/18* (2006.01)

(52) U.S. Cl.
CPC ..... *B65B 31/025* (2013.01); *B65B 3/18* (2013.01)

(58) Field of Classification Search
CPC ..... B65B 31/02; B65B 3/18; B65B 31/025; B65B 25/041; B65B 29/08
USPC ..... 53/266.1, 510, 239; 426/397, 392, 131, 426/406, 400
See application file for complete search history.

(56) References Cited

U.S. PATENT DOCUMENTS 1,386,887 A * 8/1921 Malmquist ..... A23B 7/00 426/404
1,625,207 A * 4/1927 Hansen ..... A23B 7/00 426/402

(Continued)

FOREIGN PATENT DOCUMENTS

DE 31 44 854 A1 8/1982
GB 2089191 A * 6/1982 ..... A23F 5/243

OTHER PUBLICATIONS

International Search Report, dated Jan. 2, 2012, from corresponding PCT application.

*Primary Examiner* — Rena L Dye
*Assistant Examiner* — Ashley Axtell
(74) *Attorney, Agent, or Firm* — Young & Thompson

(57) ABSTRACT

A method for packaging non-liquid food products, particularly those sensitive to oxygen, such as vegetables, in a container with a low oxygen content, the container including an opening. The method includes the following steps: the container is filled with the products, in a non-controlled atmosphere; the air is removed from the container by filling same to capacity with a liquid; the full container is placed in a non-oxidizing atmosphere formed by at least one non-oxidizing gas; the liquid is fully or partially emptied from the container in a non-oxidizing atmosphere while the food products are kept in the container, such that the at least one non-oxidizing gas replaces the liquid in the container; and the above-mentioned container opening is closed in a gas-tight manner in a non-oxidizing atmosphere. A unit for carrying out the method is also described.

16 Claims, 3 Drawing Sheets

(56) References Cited

U.S. PATENT DOCUMENTS 1,975,012 A * 9/1934 McKinnis ..... A23F 5/105
426/402
2,054,492 A 9/1936 Young
2,286,999 A * 6/1942 Smith, Jr. ..... A23L 3/0155
426/404
3,321,887 A 5/1967 Manas
3,477,192 A 11/1969 Brown et al.
3,641,917 A * 2/1972 Vallee ..... A23L 3/06
99/455
4,717,575 A * 1/1988 Larroche ..... A23L 3/0155
220/203.09
5,457,939 A * 10/1995 Bardou ..... B65B 55/027
426/403
5,916,110 A 6/1999 Sanfilippo et al.

* cited by examiner

METHOD FOR PACKAGING NON-LIQUID FOOD PRODUCTS, IN PARTICULAR THOSE SENSITIVE TO OXYGEN, IN A CONTAINER WITH A LOW OXYGEN CONTENT

FIELD OF THE INVENTION

This invention relates to a method for packaging non-liquid food products, such as in particular vegetables, in particular those sensitive to oxygen, in a container with a low oxygen content.

The invention also relates to a unit for carrying out the method.

BACKGROUND OF THE INVENTION

In order to preserve non-liquid food products (i.e.; vegetables or pieces of meat), sensitive to oxygen, it is known to package said food products in a packaging with a low oxygen content.

In the case of packaging that is substantially dimensionally stable, such as for example metal tins filled in limited juice, the reduction in the oxygen content is obtained primarily by placing the metal tin in a vacuum. Possibly, a non-oxidising gas (i.e. $N_2$) sweeps the products in order to remove the residual oxygen.

The tin is then closed with a lid which is crimped in a vacuum. In order to substantially reduce the quantity of oxygen, this method requires machine speeds that are relatively low, much less than conventional industrial speeds (400 cpm).

Another disadvantage of this method resides in the fact that the packaging must be sufficiently resistant to mechanically resist a vacuum. In the case of metal tins, it is as such required to provide tin thicknesses at least equal to 0.18 mm in order to prevent said tin from imploding. Another disadvantage of this method is the difficulty in obtaining residual oxygen contents that can be reproduced.

For the case of a packaging (metal tin) with limited headspace, i.e. comprising a low volume of air in the vicinity of the opening because it is practically entirely filled with a juice, another method of inerting consists in blowing a non-oxidising gas (i.e. $N_2$) on said headspace, and simultaneously closing and crimping the lid. This method however consumes a substantial amount of non-oxidising gas and is therefore expensive.

SUMMARY OF THE INVENTION

The purpose of this invention is to overcome these aforementioned disadvantages by proposing a method for packaging products, in particular non-liquid food products, such as for example vegetables, in particular those sensitive to oxygen, in a container with a low oxygen content, which allows for high production speeds and which does not require expensive packaging in order to be carried out.

Another purpose of the invention is to propose a method making it possible to obtain a substantial reduction in the oxygen content in the packaging.

Another purpose of the invention is to propose a method that can be carried out in a unit by limiting industrial investments, and/or which results in the production of a thinner container.

As such, the invention relates to a method for packaging products, such as for example food products, in particular those sensitive to oxygen, non-liquid, such as for example vegetables or meat in pieces, in a container with a low oxygen content, said container having an opening.

According to the invention, the method comprises the following steps:

- the container is filled with the products, in a non-controlled atmosphere (ambient atmosphere),
- the air is removed from the container by filling same to capacity with a liquid,
- the full container is placed in a non-oxidising atmosphere formed by at least one non-oxidising gas,
- the liquid is fully or partially emptied from the container in a non-oxidising atmosphere while said products are kept in said container is such a way that said at least one non-oxidising gas replaces said liquid in said container.
- said opening of the container is closed in a gas-tight manner in a non-oxidising atmosphere.

According to an embodiment, said filling liquid is degassed, prior to said step of filling of the container with said liquid.

According to an embodiment, the method comprises the following steps:

- the container is filled with the products in a non-controlled atmosphere,
- the air is removed from the container by filling same to capacity with a liquid,
- the full container is placed in a non-oxidising atmosphere formed by at least one non-oxidising gas.
- the liquid is fully or partially emptied from the container in a non-oxidising atmosphere while said food products are kept in said container in such a way that said at least one non-oxidising gas replaces said liquid in said container,
- said container is filled with a final liquid, in particular food juice, in a non-oxidising atmosphere, partially,
- said opening of the container is closed in a gas-tight manner in a non-oxidising atmosphere.

According to an embodiment, the method can be carried out on a continuous production line comprising a chamber, in particular a tunnel in a non-oxidising atmosphere, filled with at least one non-oxidising gas, said chamber provided with conveying allowing for the forward motion of said containers continuously. The step of emptying of said liquid is carried out by means of a container turnover device, internal to the chamber provided with means, such as a punched wall, making it possible to keep the non-liquid food products in said container during the turning over.

According to an embodiment, the containers are metal tins.

According to an embodiment, metal tins have a wall thickness less than or equal to 0.15 mm, for example 0.12 mm.

According to an embodiment, the step of closing the container can be carried out at least by the placing of a lid. The method can further provide a step wherein the lid of the metal tin is crimped (in a non-oxidising atmosphere, or in a non-controlled atmosphere).

According to an embodiment, the products to be packaged are food products (i.e. pieces of vegetables, meat). In this case, said final liquid is a food juice (salted water, sauce, etc.).

The invention also relates to a unit for the packaging of products, non-liquid food products in particular, in particular sensitive to oxygen, in a container with a low oxygen content, on a continuous production line, said container having an opening, said unit comprising, according to the direction of forward movement of the containers, successively:

- means for filling said containers to capacity with a liquid in a non-controlled atmosphere,
- a chamber in a non-oxidising atmosphere, filled with a non-oxidising gas, said chamber being provided with means of conveying that allow for the forward movement of the containers continuously, receiving a container turnover device, internal to said chamber making it possible to empty the liquid from said containers, provided with means making it possible to keep the non-liquid products in said container during the turning over, a device for closing in a gas-tight manner the opening of said container.

The method and the unit in accordance with the invention will find particular application for the packaging of food products such as vegetables, meat or others, in dimensionally stable tins, in particular made of metal.

The invention is not limited to the packaging of food products and can have an application for the packaging of any other product that is sensitive to oxygen.

BRIEF DESCRIPTION OF THE DRAWINGS

The invention shall be better understood when reading the description and the annexed figures among which.

DETAILED DESCRIPTION OF THE INVENTION

Figure 1:
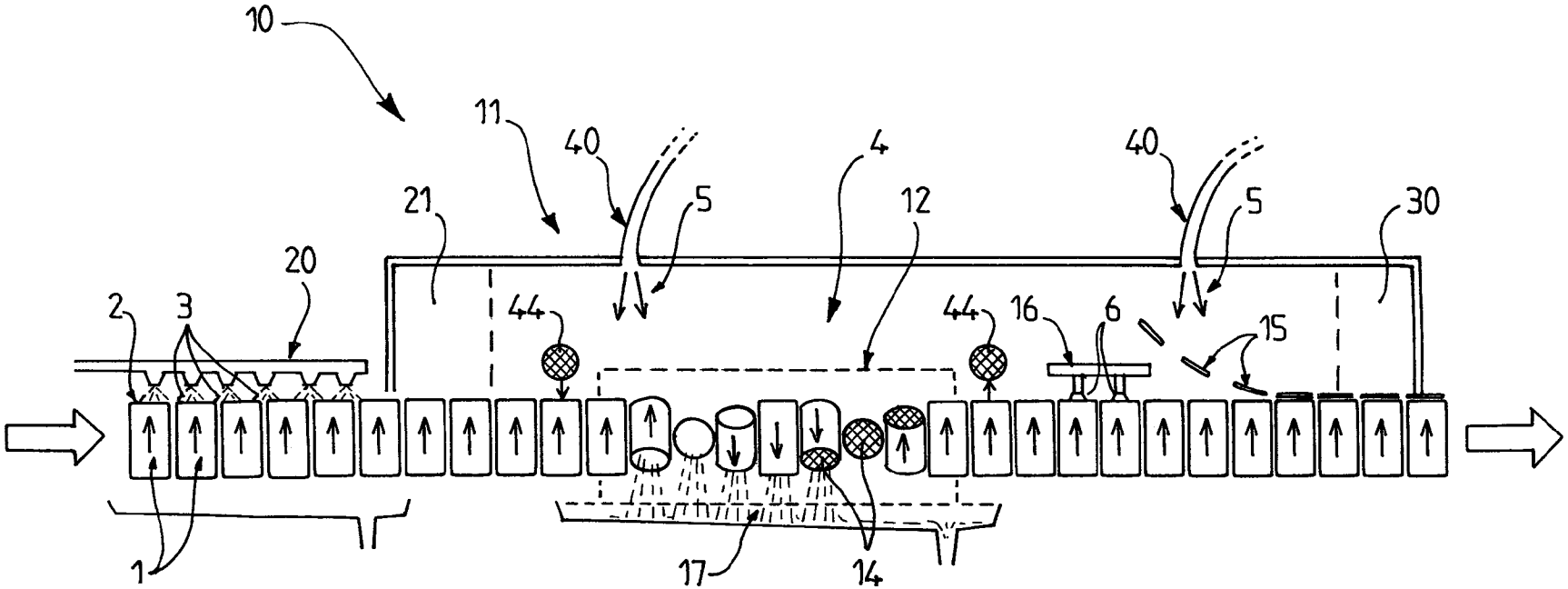
FIG. 1 is a diagrammatical view of the carrying out of the method in accordance with the invention in a unit in accordance with the invention according to a first embodiment.
Figure 2:
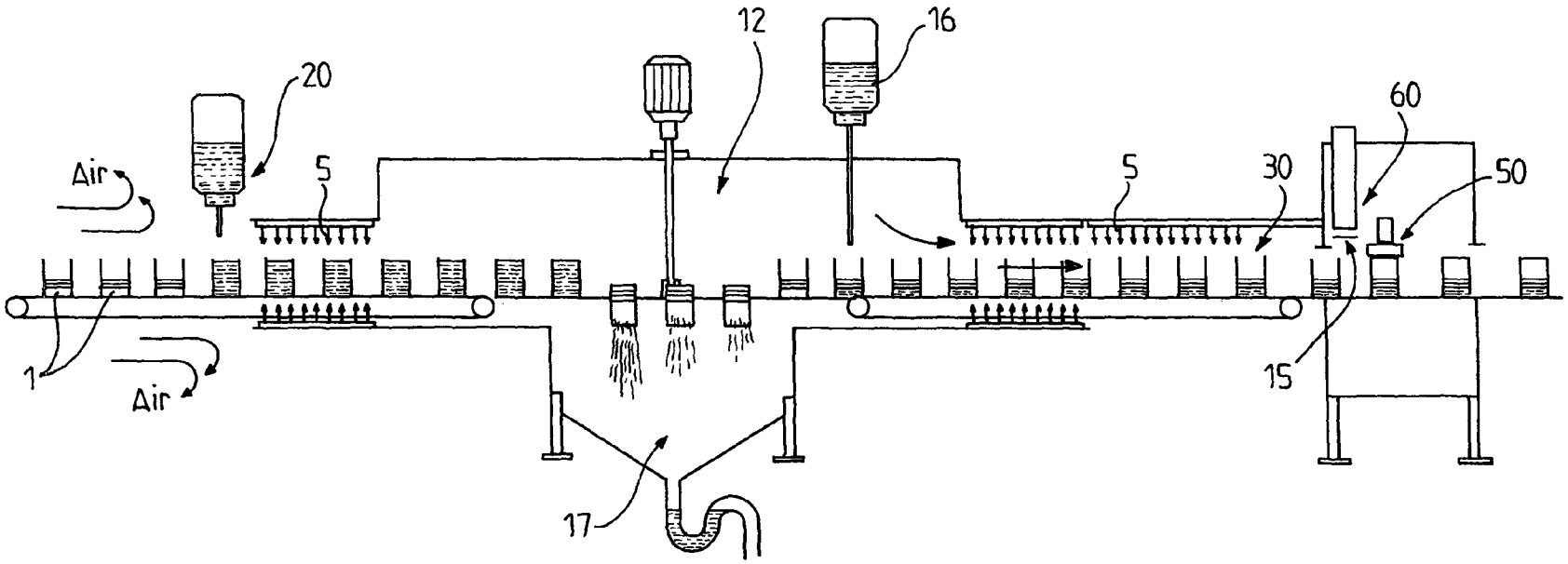
FIG. 2 is a diagrammatical view of the carrying out of the method in accordance with the invention in a unit in accordance with the invention according to a second embodiment.

As such, the invention relates to a method for packaging in particular non-liquid food products, such as for example pieces of vegetables; pieces of meat, or others, in particular those sensitive to oxygen in a container with a low oxygen content. The method can make it possible to obtain a concentration of oxygen in the packaging less than or equal to 12 ppm, even less than 6 ppm.

The container 1 has an opening 2 for its filling.

The method, in accordance with the invention, comprises the following steps:

the container 1 is filled with the products, in particular food products in a non-controlled atmosphere (not shown), the air is removed from the container by filling same to capacity with a liquid 3, the full container 1 is placed in a non-oxidising atmosphere 4, formed by at least one non-oxidising gas 5, the liquid 3 is fully or partially emptied from the container 1 in a non-oxidising atmosphere 4 while said products in particular food products are kept in said container in such a way that said at least one non-oxidising gas 5 replaces said liquid 3 in said container, said opening 2 of the container 1 is closed in a gas-tight manner in a non-oxidising atmosphere 4.

"Filling to capacity" means the complete or almost complete filling of the internal volume of said container with said products and said liquid. This is in opposition to filling "in limited juice", wherein the internal volume of said container filled with said products is not fully filled with liquid, with interstices remaining between the products.

According to an embodiment, the containers 1 can be metal tins that can have a wall thickness less than or equal to 0.15 mm, for example 0.12 mm.

The non-oxidising atmosphere can be $N_2$, $CO_2$ or another non-oxidising gas, or a mixture of these gases.

According to an embodiment, the filling liquid 3 utilised to remove the air from the container, via filling to capacity, can be degassed beforehand. The liquid 3 can be, for example, water.

According to an embodiment, the method can further have an additional step wherein the container is filled with a final liquid, in particular food juice in a non-oxidising atmosphere; the method then comprises the following steps:

the container is filled with the products, in particular food products in a non-controlled atmosphere, the air is removed from the container 1 by filling same to capacity with a liquid 3, the full container 1 is placed in a non-oxidising atmosphere 4, formed by at least one non-oxidising gas, the liquid is fully or partially emptied from the container in a non-oxidising atmosphere, while said products in particular food products are kept in said container, in such a way that said at least one non-oxidising gas replaces the liquid in said container 1, said container is filled with a final liquid 6 in particular a food juice such as a sauce, in a non-oxidising atmosphere, partially, said opening of the container is closed in a gas-tight manner in a non-oxidising atmosphere.

Advantageously, the method, in accordance with the invention, can be carried out on a continuous production line, comprising a chamber 11, such as a tunnel, in a non-oxidising atmosphere 4, filled with said at least one non-oxidising gas 5. This chamber 11 is provided with means of conveying allowing for the forward movement of the containers continuously.

The step of emptying the liquid 3 can be advantageously carried out continuously, by means of a container turnover device 12, internal to the tunnel 11. The device 12 can include according to an embodiment guides intended to engage with said containers 1, during the forward movement of said containers, in such a way as to turn said container around a traverse axis of said container by imposing a spiral trajectory of said containers. Furthermore, means make it possible to keep the non-liquid food products in the container 1 during the turning over.

Such a device for turning over 12 is known per se in prior art, usually referred to as a "tippling belt conveyor" by those skilled in the art. Document EP-0.070.195 is an example of this.

The means 14 making it possible to maintain the products, in particular non-liquid food products, during the turning over in said container 1, can be comprised of a punched wall of the device whereon will be thrust the opening 2 of the container when it is turned over. Alternatively, these means can be comprised of a punched lid 44, temporary, placed upstream of the device for turning over 12, then removed downstream of this device for turning over 12 (see FIG. 1).

Other devices for turning over can be considered. For example, the device for turning over can include individual container holders 70, each intended to maintain one container.

A mechanism including in particular a cam and a cam follower or an actuator can make it possible to control the turning over of each of the container holders 70, then to reposition each of the containers with the opening upwards.

Figure 3:
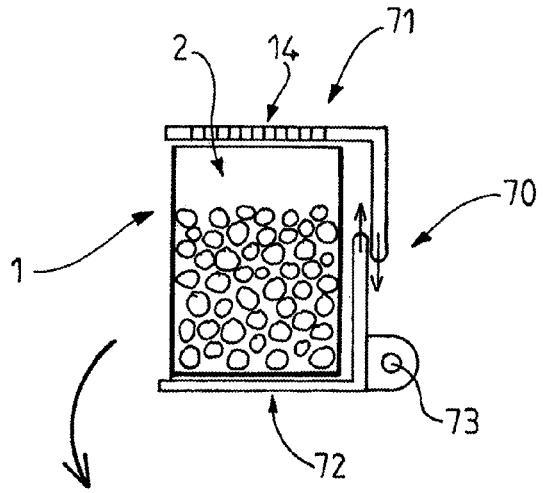
FIG. 3 is a detailed view showing a container holder carried out in the unit shown in FIG. 2 to turn over the container.
Figure 4:
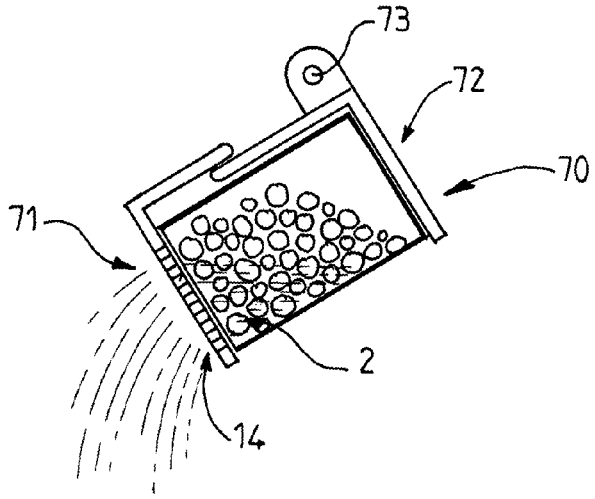
FIG. 4 is a detailed view of the container holder in FIG. 3, in turned over position.

For example, each container holder 70 can, according to the examples in FIGS. 3 and 4, include a clamp with a first jaw 71 and a second jaw 72.

The container holder 70 grasps a container by bringing the jaws 71, 72 close to one another, while the container is resting on the lower jaw (second jaw 72 such as shown in FIG. 3).

The upper jaw (first jaw 71) then comes to but against the container 1, covering the opening 2 of the container 1.

Once grasped, a mechanism allows for the joint turning over of the holder 70 and of its container 1, in particular around a pivoting axis 73 of the holder 70, in order to empty the liquid from the container.

Advantageously, the first jaw 71 comprises a punched wall, covering the opening 2 which makes it possible to keep the non-liquid products in the container (FIG. 4).

The step of closing the opening 2 of the container 1 can be carried out at least by the setting into place of a lid 15; in a non-oxidising atmosphere. The method can further provide a step wherein the lid 15 is crimped to said metal tin. This step of crimping can be carried out either in a non-oxidising atmosphere, or in a non-controlled atmosphere.

The invention also relates to a unit 10 for the packaging of non-liquid food products, in particular those sensitive to oxygen in a container 1 with a low oxygen content, on a continuous production line.

The container 1 has an opening 2 and can be a metal tin, such as described hereinabove.

Said unit 10 comprises, according to the direction of forward movement of the containers 1, successively:

- means for filling 20 said containers to capacity with a liquid 3 in a non-controlled atmosphere,
- a chamber, such as a tunnel, in a non-oxidising atmosphere, filled with a non-oxidising gas 5,
- a device 50, 60 for closing in a gas-tight manner the opening 2 of said container 1 (not shown).

Said chamber 11 is provided with means of conveying allowing for the forward movement of said containers 1, continuously, and receives a container turnover device 12, internal to said tunnel making it possible to empty the liquid 3 from said containers, and means making it possible to keep the non-liquid food products in said container during the turning over. The device 12 can include guides intended to mesh with said containers during the forward movement in such a way as to turn the container around a traverse axis of said container by imposing a spiral trajectory of said containers. Alternatively, the device can implement the previously described container holders 70.

Such as shown according to the example in FIG. 1, the containers 1, in particular metal tins, can be conveyed on the production line one right after the other, in line. The forward movement of the containers is obtained by the containers coming to abut against one another, with one upstream container pushing one downstream container.

The means for filling 20 can be comprised of a ramp for the supply of liquid provided with several nozzles supplying the containers with liquid. In this zone, the containers 2 are positioned upright, the opening of the container at the upper portion.

After filling, the containers enter into one of the ends 21 of the chamber 11 (tunnel) which can include an airlock which provides a certain degree of tightness between the non-oxidising atmosphere inside the tunnel and the outside atmosphere (ambient air). The containers 1 exit this tunnel at the other end 30 of the chamber 11 by the intermediary in particular of an airlock intended to provide a certain degree of tightness between the internal atmosphere of the tunnel and the outside atmosphere.

The interior volume of the chamber is kept in a non-oxidising atmosphere 4 kept in a slight overpressure by the intermediary of means of nozzles 40, with non-oxidising gas 5.

The container turnover device 12 is provided internal to the chamber 11. This device 12 comprises, according to the example in FIG. 1, guides intended to engage with the container during the forward movement of said containers in such a way as to turn said container around a traverse axis of said container by imposing a spiral trajectory of said containers as such making it possible to empty said container.

Such as shown, the containers 1 enter one end of the device 12 (shown as a dotted line) upright, with the opening of the container oriented upwards (indicated by the arrow), then are turned over in order to empty the container fully or partially.

They are reoriented by the device 12 so that the opening 2 of the container is oriented upwards at the exit. Possibly, container 1 can pass through an intermediary position, turned to 180°, such as is shown in FIG. 1.

The means making it possible to keep the non-liquid food products in the container 1, during the turning over, can be comprised of a punched lid 14, which is placed on the opening of the container 2, before it enters the device 12, then removed at the exit of the device 12 such as shown in FIG. 1.

Alternatively, these means can be comprised of a punched wall of the device 12 whereon will be thrust the opening 2 of the container when it is turned over.

A drain 17 can be provided, in alignment, under the device 12 for the recovery and the drainage of liquids escaping from said device 12.

The unit 10 can further have, such as is shown in FIG. 1, means for supplying 16 a final liquid 6, such as a food juice inside the chamber 11. These means of supplying 16 include means for metering and make it possible to partially fill the containers with a food juice 6, such as for example a sauce.

Finally, a device 60 can allow for the placing of a lid 15 on the opening 2 of the container 1, in order to keep the non-oxidising gas in place in the container 1. An atmospheric crimping 50, even a crimping machine under pressure of a non-oxidising gas internal to the chamber 11, can make it possible to successively attach the lid to said tin.

Note that the applicant filed on the same day a patent application for a method of packaging products in particular food sensitive to oxygen, specially intended for liquid products and which also comprises for general principle to fill to capacity the container in order to remove the air from the container, to place the container in a non-oxidising atmosphere, and to empty the liquid from the container, partially, before closing the container in gas-tight manner.

Naturally, other embodiments could have been considered par those skilled in the art, without however leaving the scope of the invention defined by the claims hereinafter.

The invention claimed is:

1. A method for packaging non-liquid products sensitive to oxygen in at least one container with a low oxygen content, said at least one container having an opening said method comprising the steps of:

- filling the at least one container with the non-liquid products, in a non-controlled atmosphere,
- removing air is from the at least one container comprising the non-liquid products by filling said at least one container to capacity with a filling liquid,
- placing the at least one full container in a non-oxidising atmosphere, formed by at least one non-oxidising gas,
- fully or partially emptying the filling liquid from the at least one container in a non-oxidising atmosphere while said non-liquid products are kept in said at least one container in such a way that said at least one non-oxidising gas replaces said filling liquid in said at least one container,
- closing said opening of the at least one container in a gas-tight manner in a non-oxidising atmosphere.

2. The method according to claim 1, wherein said filling liquid is degassed, prior to filling said at least one container comprising the non-liquid products with said filling liquid.

3. The method according to claim 2, wherein after said step of fully or partially emptying of said filling liquid and before said step of closing said opening of the at least one container, said at least one container is partially filled with a final liquid, in a non-oxidising atmosphere.

4. The method according to claim 2, wherein the method is carried out on a continuous production line comprising a chamber, filled with said at least one non-oxidising gas to provide a non-oxidising atmosphere inside of said chamber, said chamber being provided with conveying for the forward movement of said at least one container continuously, the step of fully or partially emptying said filling liquid is carried out by a container turnover device, said turnover device is internal to said chamber, and said turnover device keeps the non-liquid products in said at least one container when turning over said at least one container to empty said filling liquid.

5. The method according to claim 2, wherein the at least one container is a metal tin.

6. The method according to claim 1, wherein after said step of fully or partially emptying of said filling liquid and before said step of closing said opening of the at least one container, said at least one container is partially filled with a final liquid, in a non-oxidising atmosphere.

7. The method according to claim 6, wherein the method is carried out on a continuous production line comprising a chamber, filled with said at least one non-oxidising gas to provide a non-oxidising atmosphere inside of said chamber, said chamber being provided with conveying for the forward movement of said at least one container continuously, the step of fully or partially emptying said filling liquid is carried out by a container turnover device, said turnover device is internal to said chamber, and said turnover device keeps the non-liquid products in said at least one container when turning over said at least one container to empty said filling liquid.

8. The method according to claim 6, wherein the at least one container is a metal tin.

9. The method according to claim 1, wherein the method is carried out on a continuous production line comprising a chamber, filled with said at least one non-oxidising gas to provide a non-oxidising atmosphere inside of said chamber, said chamber being provided with conveying for the forward movement of said at least one container continuously, the step of fully or partially emptying said filling liquid is carried out by a container turnover device, said turnover device is internal to said chamber, and said turnover device keeps the non-liquid products in said at least one container when turning over said at least one container to empty said filling liquid.

10. The method according to claim 9, wherein the at least one container is a metal tin.

11. The method according to claim 1, wherein the at least one container is a metal tin.

12. The method according to claim 11, wherein the metal tin has a wall thickness less than or equal to 0.15 millimeters.

13. The method according to claim 11, wherein the step of closing the opening of said at least one container is carried out at least by setting in place a lid.

14. The method according to claim 13, wherein the lid is crimped to said metal tin.

15. The method according to claim 1, wherein the non-liquid products are pieces of vegetables or meat.

16. A unit for the packaging of non-liquid products sensitive to oxygen, in at least one container with a low oxygen content, on a continuous production line, said at least one container having an opening, said unit comprising, according to the direction of forward movement of the at least one container, successively:

means for the continuous filling to capacity of said at least one container with a filling liquid, a chamber filled with a non-oxidising gas to provide a non-oxidising atmosphere inside of said chamber, said chamber being provided with means of conveying said at least one container continuously in the forward movement, said chamber comprising a container turnover device, internal to said chamber, to empty the filling liquid from said at least one container equipped with means keeping the non-liquid products in said at least one container when said at least one container is turned over, and a device for closing in a gas-tight manner the opening of said at least one container.

* * * * *